United States Patent [19]

Drusel

[11] Patent Number: 4,927,142

[45] Date of Patent: May 22, 1990

[54] SUPPORTING DEVICE FOR NET POSTS IN TENNIS COURTS

[76] Inventor: Norbert Drusel, Im Schluh 12, 2862 Worpswede, Fed. Rep. of Germany

[21] Appl. No.: 295,110

[22] Filed: Jan. 6, 1989

[30] Foreign Application Priority Data

Jan. 29, 1988 [DE] Fed. Rep. of Germany ..... 3802655

[51] Int. Cl.[5] ..... A63B 61/02

[52] U.S. Cl. ..... 273/29 BB; 273/29 BC

[58] Field of Search ..... 273/29 B, 29 BB, 29 BC, 273/29 BD, 29 BE, 29 BF, 29 BG, 26 E, 410, 411

[56] References Cited

U.S. PATENT DOCUMENTS 1,444,344 2/1923 Gourley ..... 273/29 BD
4,030,733 6/1977 Merrihew et al. ..... 273/29 BB
4,109,910 8/1978 Gleason ..... 273/29 BB
4,706,964 11/1977 Genovese ..... 273/26 E
4,732,395 3/1988 Halverson ..... 273/29 BB

FOREIGN PATENT DOCUMENTS 403184 12/1933 United Kingdom ..... 273/29 BB

*Primary Examiner*—T. Brown
*Attorney, Agent, or Firm*—McGlew & Tuttle

[57] ABSTRACT

A supporting device for the mounting of net posts for tennis nets on tennis courts comprises an alignable lever having elastic feet on its lower side. The feet extend flat over the ground of the court toward the horizontal stress created by tension in a net. A support structure is provided for the vertical mounting of a net post. The device has rollers, which are mounted eccentrically of a lever weighted portion and are freely rotatable.

7 Claims, 1 Drawing Sheet

SUPPORTING DEVICE FOR NET POSTS IN TENNIS COURTS

FIELD AND BACKGROUND OF THE INVENTION

The invention relates in general to net games and in particular to a new and useful supporting device for the mounting of the net posts for tennis nets and the like.

A supporting device of this type is known from German GM No. 77 25 037. Such a supporting device is designed to achieve more mobility by using a play field for various games in which nets are of varying height. This type of supporting device is not the task of the invention.

In tennis courts it is general practice to mount the tennis net to net posts, which are guyed permanently to the ground or which can be inserted into a holder embedded in the ground. Due to this the fastening of the net is tied to the conditions given by the regular size of the tennis courts. A court size designed for adult players with the respective net height is not suited for children and often leads to disappointment, because tennis is not correctly represented for them. Therefore, satisfying educational success and fun for children from about five years and up has been achieved through so-called "short-tennis". A short-tennis court has about the size of a badminton court. The net is much lower, the inner pressure of the ball is less than for regular tennis and the racket has a shorter handle. The cited patent does not deal with the design of the court for short-tennis.

U.S. Pat. No. 4,109,910 also describes a supporting device for a net post for tennis nets, which is to be put down on the ground loosely, i.e. with no connection to the ground. According to this publication, stability is to be achieved by filling a fluent material into hollow spaces. This publication does not deal with the design of the supporting device according to the invention.

SUMMARY OF THE INVENTION

The invention makes it possible to teach the game to children by temporarily installing several short-tennis courts in places which are not equipped with devices for the mounting of nets and also to avoid damage on the often very expensive and sensitive floors in gymnasiums and outside during the mounting of the tennis net.

According to the invention a supporting device for net posts includes a mounting for a tennis net which sits loosely, e.g. is merely set onto or over the ground of a sport hall and which has nevertheless enough stability to support a tennis net. This is especially true for the tennis nets for short tennis courts, which have a lower height and wherein the pitching moment induced by the tension of the net and effecting the net posts is relatively small. The pitching moment is counter-weighed by the moment of the weight load which is arranged at some distance from a tipping axle. The elastic feet on the lower side of the lever or of a weight do not leave any traces on the surface of the stadium, not even with textile covered surfaces in sports halls and the like.

However, the characteristics according to the invention are also applicable for supporting devices for the anchoring of net posts carrying tennis nets, as the measurements of the supporting device can be adjusted to higher net posts and respectively higher pitching moments without any problem. Therefore, the supporting devices according to the invention are also usable for the temporary mounting of tennis courts in multipurpose halls or the like.

The present design creates a relatively high countermoment for the pitching moment resulting from the tension of the net and acting upon the supporting device. Also, the design according to the invention permits the mounting and the removing of the supporting device by children. An eccentric mounting of rollers at the end of a round weight permits these rollers to have contact with the ground as soon as a lever or support arm is turned around the axis of the weight. The children can then pull the supporting device off the playing area to a storage space on these rollers.

According to a further embodiment of the invention, a muff joint for the fastening of the net post is provided on the upside of the lever. The muff joint is arranged between the feet with regard to the weight. Such a muff joint may also serve to suspend the supporting device on a peg or the like just above the ground.

A pocket is attached to the edges of the net and can be slipped over the net post which can be joined with the supporting device. A tensioning guy line goes through the edge of the net and has an outer end which extends outwardly from the net and is connected to a loop or the like fixedly connected to the weight. By this means the vertical edge of the net is immediately adjacent to the net post, thus it does not have to be bound to the post.

For the mounting of the device on textile floors, artificial lawn and the like, the use of flat suction cups from elastic material which are standard in trade have proven useful.

Accordingly it is an object of the invention to provide an improved apparatus for supporting a net above a support such as the ground which comprises a weight with a lever having one end connected to the weight and an opposite end which extends outwardly of the weight and is selectively positionable horizontally in an operative net supporting position and upright in a transport position for rolling movement of the apparatus over the ground, and in which the lever carries a post mounting apparatus based on its outer opposite end and rollers are mounted on the weight and are located so that they project outwardly from the periphery of the weight and engageable with the ground for rolling movement during transport.

A further object of the invention is to provide a device for supporting the mounting of net posts which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
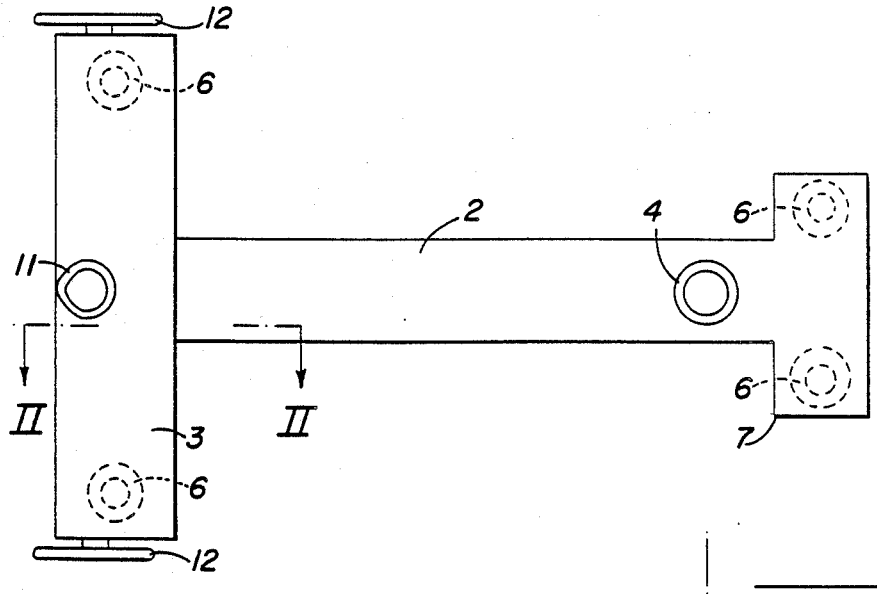
FIG. 1 is a top view of a supporting device according to the invention.

Referring to the drawings in particular, the invention embodied therein comprises an apparatus for supporting a net 1 above a support such as the ground of a court of arena 13. The apparatus comprises a weight 3 which is connected to one end of a lever which has an opposite end which extends outwardly of the weight and is selectively positionable either horizontally in an operative net supporting position or upright in a transport position for rolling movement of the apparatus over the ground or court. In accordance with the invention, the post carries net supporting means in the form of a receiving pocket of muff joint 4 which accommodates an upright or post 5 which has an upper end which is engaged into a pocket 9 of a reinforcement band of the net 1. The invention further includes roller means rotatably mounted on the weight 3 in a position such that they project outwardly from the periphery of the weight 3 and are engageable with the ground for rolling transport movement.

Figure 2:
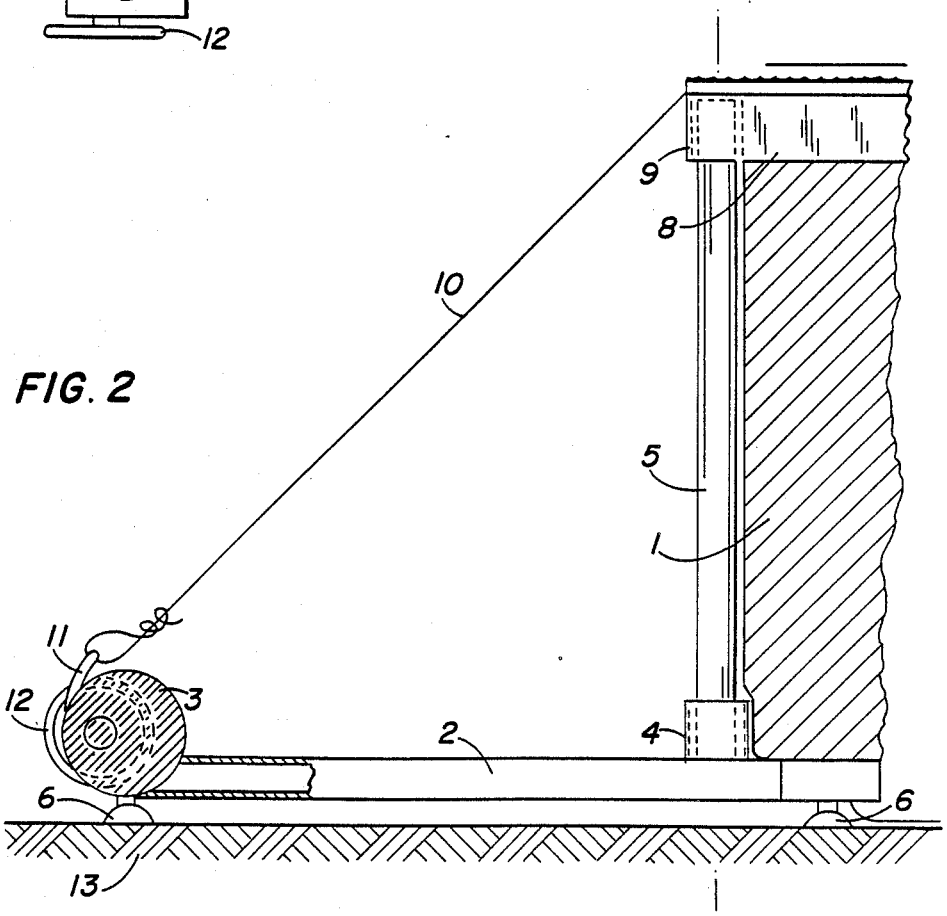
FIG. 2 is a side view of the supporting device, partly in section taken along the line II—II of FIG. 1, and also showing an end of an attached net.

The supporting device comprises, alignable lever or support arm 2 which extends flat over the ground of the court toward the horizontal stress created by the tension in a net 1 and a weight 3. The lever 2 is preferably made from a hollow profile of a material of low specific density and the weight 3 is made of a material of relatively high specific density. The weight 3 is mounted to the outer end of the lever 2, e.g. welded to it. On the inner end of the lever 2 which is near to the net, there is a muff joint or receiving socket 4 in which the bottom end of a tube-shaped net post 5 can be inserted, and which is mounted to the upside of the lever 2. Elastic feet 6 are provided for the support of the supporting device on the ground or a sports arena. Sufficient stability under load in transverse directions of the net are achieved by arranging the elastic feet at a predetermined distance from one another. In addition, the end of the lever 2 adjacent to the net 1 can be equipped with a cross-shaped extension 7 and it provides at least two additional elastic feet 6 at a distance to one another. A pocket 9 is attached at the end of the upper net edge 8 and it can be slipped over the net post 5 so that the vertical edge of the net is adjacent to the net post 5, as shown in FIG. 2. The tensioning guy line 10 is attached to a loop 11 on the weight 3 and engaged with the top of the pocket 9. The guy line is stretched out which regard to the tensioning direction of the net edge 8. Rollers 12 each mounted eccentrically at the end of each weight 3 so that only a section of the rollers 12 protrudes with regard to the limit of each weight 3. By shifting the weight 3 and the lever 2 around the axis of the weight 3 which is at a right angle with regard to the tensioning direction of the net edge 8, the rollers 12 are permitted to have contact with the ground 13, as can be seen from FIG. 2.

By shifting the lever 2 to the side opposite the side shown in FIG. 2, the supporting device leans against the ground 13 with the rollers 12, so that it can be rolled to a different location, i.e. from the mounting location to a storage place.

While a specific embodiment of the invention has been shown and described in detail to illustrate the application of the principles of the invention, it will be understood that the invention may be embodied otherwise without departing from such principles.

What is claimed is:

1. A supporting device for supporting a tennis net on a tennis court, comprising:

A tennis net and a pair of vertically extending tennis net support posts said net being attached between said support posts by a net support means;

A horizontally extending lever having first and second ends and top and bottom surfaces, mounting means adjacent said first end and on said top surface mounting a lower end of at least one of said support post to said lever; an elongate, cylindrical weight means attached to said second end of the top surface of said lever, said weight means extending substantially perpendicular to a longitudinal recess of said lever and eccentrically mounted roller means disposed at each end of said cylindrical weight for rotation about an axis, said axis being offset from a longitudinal axis of said weight means, a net tension line attachment means attached intermediate the ends of said weight means for attachment at least one of said support post, a net tension line extending from said tension line attachment means to the top of said at least one of said support post for holding said tennis net support means in a taunt condition, and an elastic support means on said bottom of said lever.

2. A supporting device according to claim 1, wherein said mounting means comprises a receiving socket on said lever forming a net post receiving opening, and said elastic support means includes elastic members forming support feet extending outwardly from said lever member toward the tennis court surface for supporting the lever member on the tennis court surface.

3. A supporting device according to claim 1, wherein said lever member has a crosspiece at said first end thereof extending substantially parallel to said weight means, said elastic support means include an elastic foot extending downwardly from each end of said crosspiece on each side of said mounting means.

4. A supporting device according to claim 1, wherein said net mounting means comprises a cylindrical socket, a cylindrical post engaged in said socket and having a rounded upper end and including a tennis net having an upper end with a receiving pocket which is engageable over the top of said post.

5. A supporting device according to claim 1, wherein said attachment means includes a loop for supporting and for receiving said net tension line.

6. An apparatus for supporting a net above a support surface such as the ground, comprising a weight having a first end and a second end, a lever having one end connected to said weight intermediate said first and second ends and said lever having a second end opposite said one end extending outwardly from said weight, said lever being selectively positionable horizontally in an operative net supporting position and upright in a transport position for rolling movement of the apparatus over the support surface, net supporting post means mounted on said lever adjacent said opposite end, roller means rotatably mounted on said weight and projecting outwardly from the periphery of said weight and engageable with the support surface for said rolling movement on said support surface.

7. An apparatus according to claim 6, wherein said net support post means includes a cylindrical open top socket mount on said lever, a net post having a lower end engaged in said socket and having an upper end extending upright therefrom, a net having a top portion with a downwardly open pocket engaged over said net post, a loop on said weight extending outwardly of the periphery thereof, a tensioning guideline engaged with said loop and engaged with the top of said pocket, and resilient means carried by said lever for resiliently supporting said lever on the ground.

* * * * *